US007988343B2

(12) United States Patent
Palmisano, Jr.

(10) Patent No.: US 7,988,343 B2
(45) Date of Patent: Aug. 2, 2011

(54) EASY-GLIDE OFFSHORE READY LIGHT TOWER SYSTEM

(76) Inventor: Lester J. Palmisano, Jr., Belle Chasse, LA (US)

( * ) Notice: Subject to any disclaimer, the term of this patent is extended or adjusted under 35 U.S.C. 154(b) by 255 days.

(21) Appl. No.: 12/110,984

(22) Filed: Apr. 28, 2008

(65) Prior Publication Data

US 2008/0266859 A1 Oct. 30, 2008

Related U.S. Application Data

(60) Provisional application No. 60/914,289, filed on Apr. 26, 2007.

(51) Int. Cl.
*F21V 33/00* (2006.01)

(52) U.S. Cl. ..... 362/424; 362/419; 362/422; 362/431; 362/249.11; 362/249.09; 362/190; 362/192

(58) Field of Classification Search ..... 362/251, 362/249.09, 249.07, 249.11, 184, 190, 191, 362/192, 418, 419, 422, 423, 424, 431
See application file for complete search history.

(56) References Cited

U.S. PATENT DOCUMENTS

| | | | | |
|---|---|---|---|---|
| 5,418,701 | A * | 5/1995 | Hart | 362/376 |
| 5,806,963 | A * | 9/1998 | Miller et al. | 362/192 |
| 6,276,811 | B1 * | 8/2001 | Yoshimori et al. | 362/192 |
| 6,496,123 | B2 * | 12/2002 | Brinkman | 340/908 |
| 2003/0137840 | A1 * | 7/2003 | Citron et al. | 362/250 |
| 2008/0037265 | A1 * | 2/2008 | Hsu | 362/388 |

* cited by examiner

*Primary Examiner* — Laura Tso
(74) *Attorney, Agent, or Firm* — Raymond G. Areaux; Ian C. Barras; Carver, Darden, Koretzky, Tessier, Finn, Blossman & Areaux, LLC

(57) ABSTRACT

An easy-glide portable light tower system having a transport enclosure for fully recessing and confining the system therein. The system includes a telescopic mast that is constructed to be stowed in a vertically upright position. The telescoping sections of the mast include frictionless pads to create frictionless surfaces between two adjacent and concentric telescoping sections or the mast base. The transport enclosure also includes stabilizing channels to stabilize arms supporting the lights.

151 Claims, 15 Drawing Sheets

EASY-GLIDE OFFSHORE READY LIGHT TOWER SYSTEM

CROSS-REFERENCE TO RELATED APPLICATIONS

The present application claims priority from U.S. Provisional Application No. 60/914,289, filed Apr. 26, 2007, which is incorporated herein by reference as if set forth in full below.

BACKGROUND OF THE INVENTION

1. Field

The present invention relates to offshore light towers and, more particularly, to an easy-guide portable light tower system having a telescopic light assembly adapted to be fully recessed into a transport enclosure when stowed.

2. Background

Portable light towers are currently manufactured for onshore use. These portable light towers include a generator with a pair of wheels. These land based portable light towers are not built for the off-shore environment and require extensive retrofitting.

Furthermore, when transported the portable light towers are not fully recessed in or confined in a transport enclosure. Instead, parts of the lights and other components are often unprotected and are damaged upon arrival to the off-shore site. This may lead to long delays in an environment where lost time is very costly.

The portable light tower systems are also stowed in a horizontal position. For operation, the mast of the system is rotated from a horizontal position to a vertical position. Thereafter, the mast can be telescoped. This increases the mechanical parts that can fail on the job site.

Thus, there is a need for a portable light system that can be fully protected during transport and eliminates the rotation of the mast to and from a horizontal position to a vertical position.

SUMMARY OF THE INVENTION

An aspect of the invention includes a system comprising: a transport enclosure constructed and arranged for an off-shore environment and having a horizontal perimeter boundary and a vertical perimeter boundary. The system also includes a telescopic light assembly mounted to the transport enclosure and operable to telescope vertically to extend beyond the vertical perimeter boundary and which, when stowed, is fully recessed and confined in the transport enclosure within the vertical and horizontal perimeter boundaries.

A further aspect of the present invention is to provide the transport enclosure with stabilizing channels supported from two parallel horizontal support members in proximity to receive free ends of the left and right arms when the mast is essentially at zero degrees.

A further aspect of the present invention is to provide a telescopic mast which comprises a plurality of concentric telescoping sections, wherein a top end of each telescoping section has a plurality of pads to create a frictionless surface between two adjacent telescoping sections.

A still further aspect of the present invention is to provide Teflon pads as frictionless surfaces so that as the telescopic mast is telescoped upward or downward in an easy-glide manner without the need for oils or other lubricants.

A still further aspect of the present invention is to provide a telescopic light assembly that is directly mounted to the transport enclosure to a vertically upright position and is stowed in the vertically upright position.

A still further aspect of the present invention is to provide an electric cable chamber positioned immediately adjacent the telescopic mast of the telescopic light assembly. The electric cable chamber stores a coiled electric cable which delivers power to lights of the telescopic light assembly. The electric cable chamber is arranged to automatically dispense therefrom as the telescopic mast is raised and receive therein the coiled electric cable as the telescopic mast is lowered.

Additional aspects will become more readily apparent from the detailed description, particularly when taken together with the appended drawings.

BRIEF DESCRIPTION OF THE DRAWINGS

For a further understanding of the nature and objects of the present invention, reference should be had to the following description taken in conjunction with the accompanying drawings in which like parts are given like reference numerals.

DETAILED DESCRIPTION OF THE INVENTION

Figure 1:
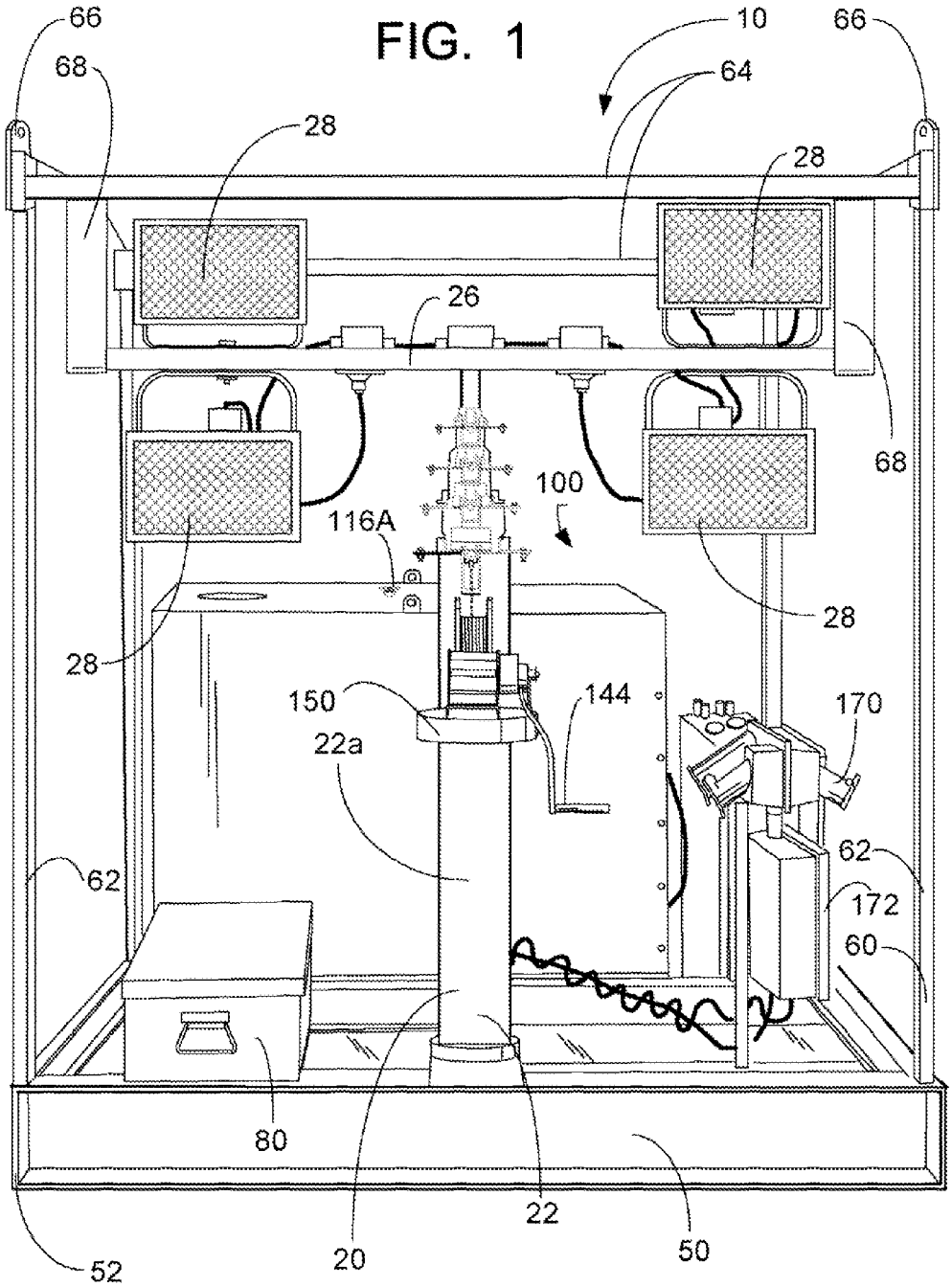
FIG. 1 shows a front view of an easy-guide portable light tower system of the present invention with the telescopic light assembly in a stowed position.
Figure 2:
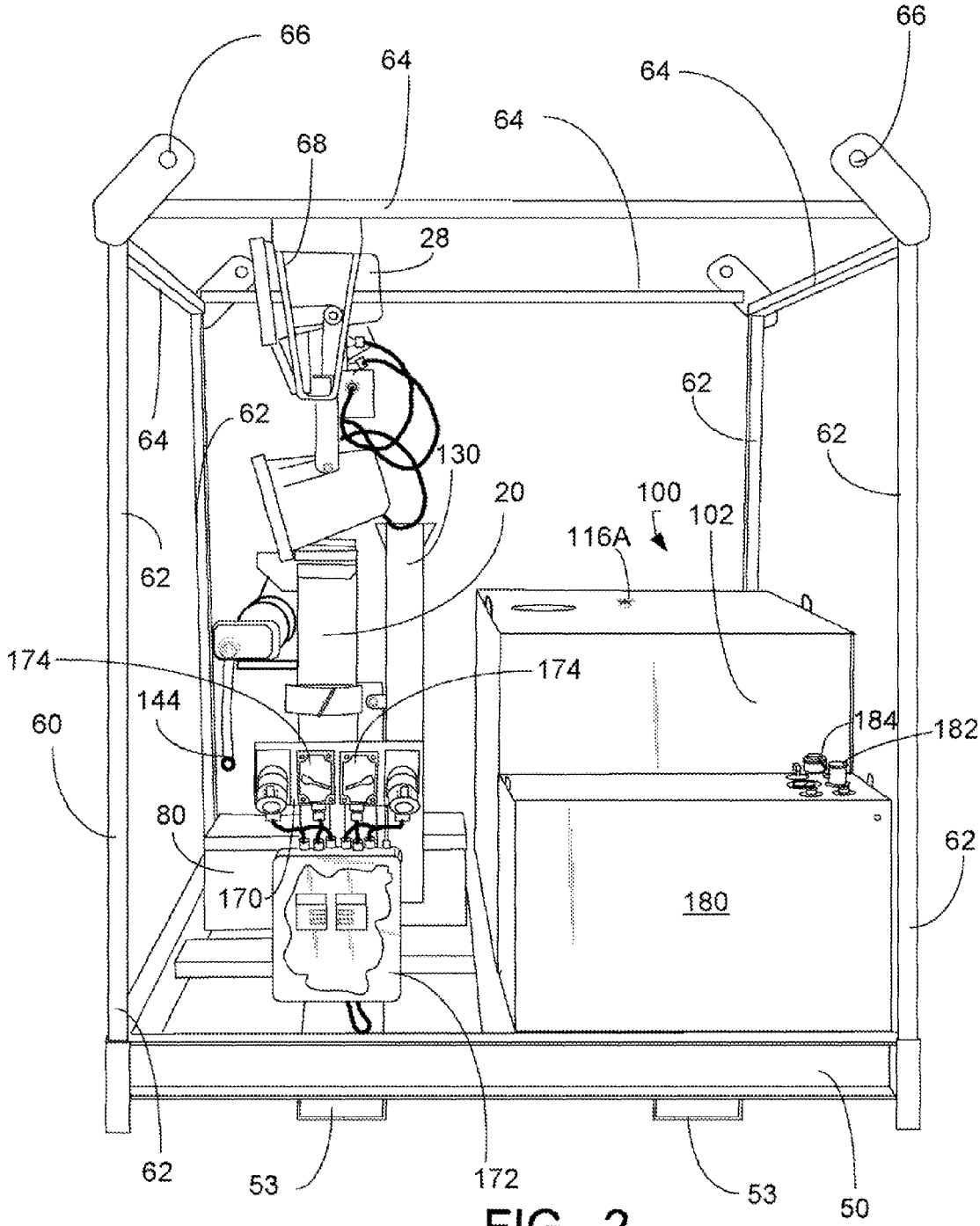
FIG. 2 shows a side view of the easy-guide portable light tower system of FIG. 1.

Referring now to the drawings, and more particularly to FIGS. 1-2 the easy-guide portable light tower system is shown. The easy-guide portable light tower system is generally designated at reference numeral 10 and is shown with the telescopic light assembly in a stowed position.

Figure 6:
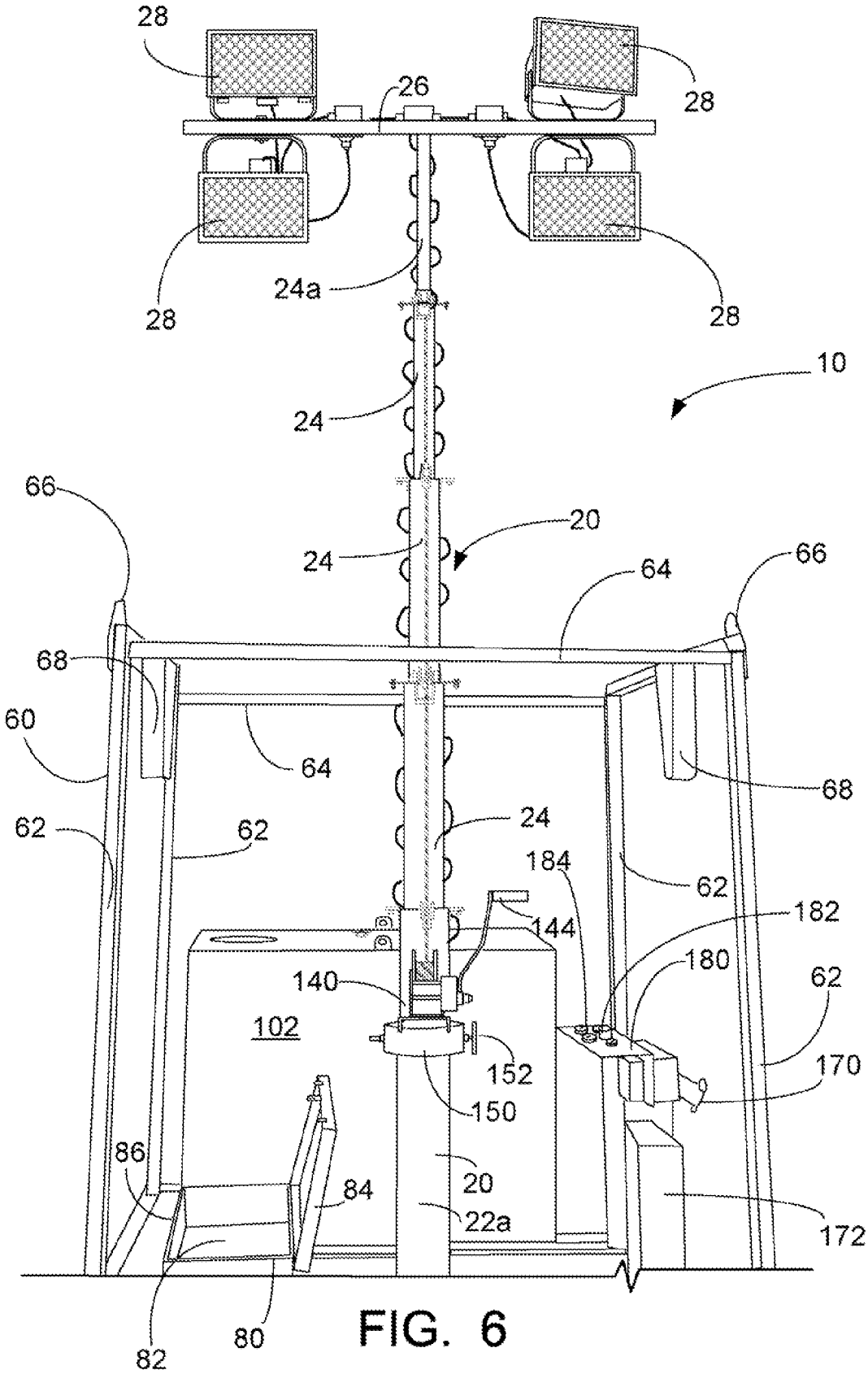
FIG. 6 shows a front view of the easy-guide portable light tower system of the present invention with the telescopic light assembly in a fully telescoped position.
Figure 7:
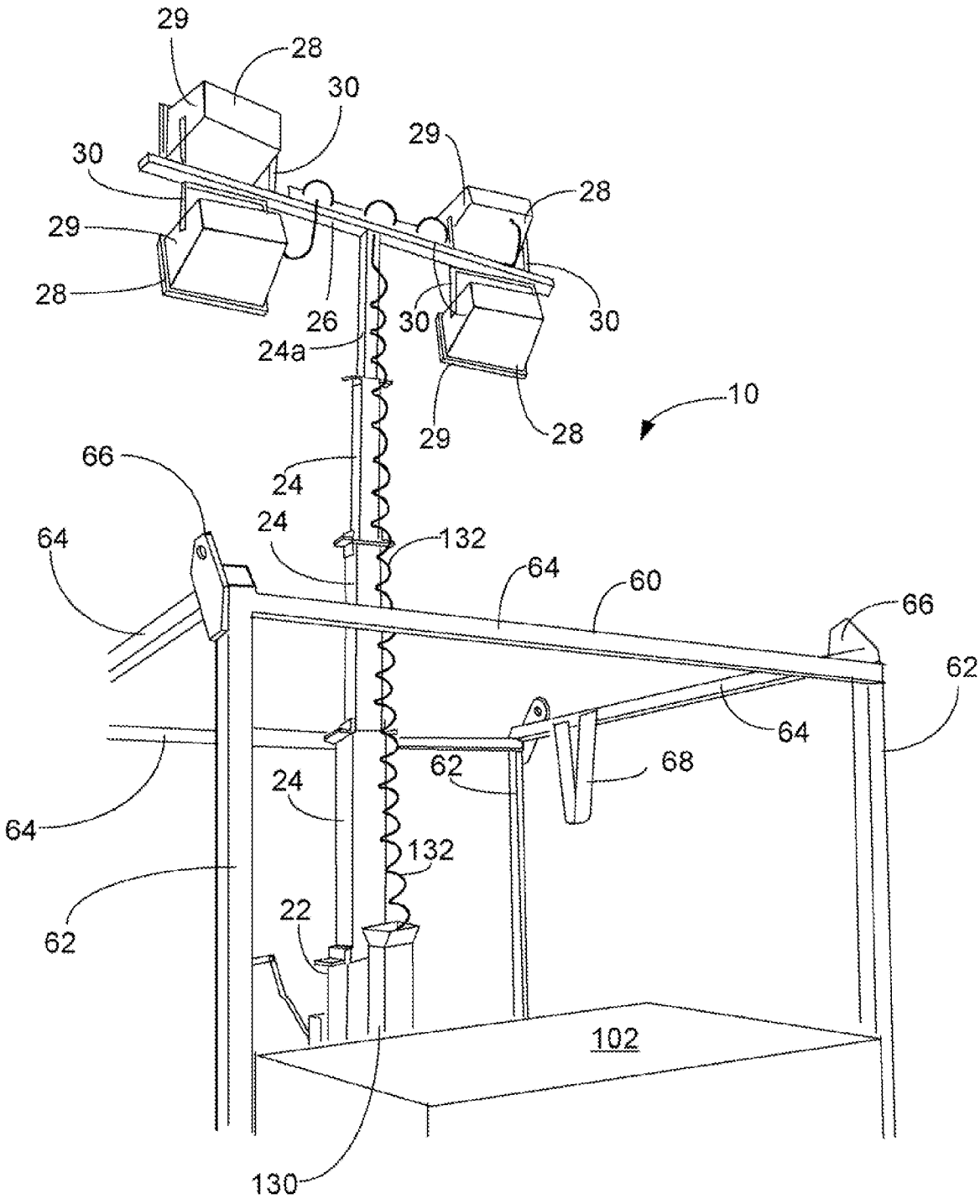
FIG. 7 shows a rear view of the easy-guide portable light tower system of the present invention with the telescopic light assembly in a fully telescoped position.

Referring specifically to FIG. 1, the easy-guide portable light tower system 10 includes a telescopic light assembly 20 swivelly mounted to a skid 50. The telescopic light assembly 20 is mounted to swivel in a Y-plane clock-wise and counter-clock wise as be seen in FIGS. 8 and 14. The swivel connection of the telescopic light assembly 20 is adapted to be rotated up to 360°. The telescopic light assembly 20 is constructed and arranged to telescope from a stowed position (FIG. 1) at zero degrees (0°) to a fully telescoped position (FIGS. 6 and 7). The telescopic light assembly 20 is not constructed to be rotated to and/or from a horizontal plane to a vertical plane.

The telescopic light assembly 20 includes a telescopic mast 22 having a mast base 22*a* from which a plurality of telescoping sections 24 are telescoped. The top telescoping section (herein after referred to as "top telescoping section 24*a*") has mounted perpendicularly thereto a crossbar member 26 so as to form a T-shaped telescopic support for a plurality of lights 28. The crossbar member 26 essentially creates two arms to hang or support the plurality of lights 28.

In the exemplary embodiment, the telescopic mast 22 is made of galvanized structural steel. The telescopic mast 22 is capable of telescoping 16 ft. and is a single stage boom.

Figure 14:
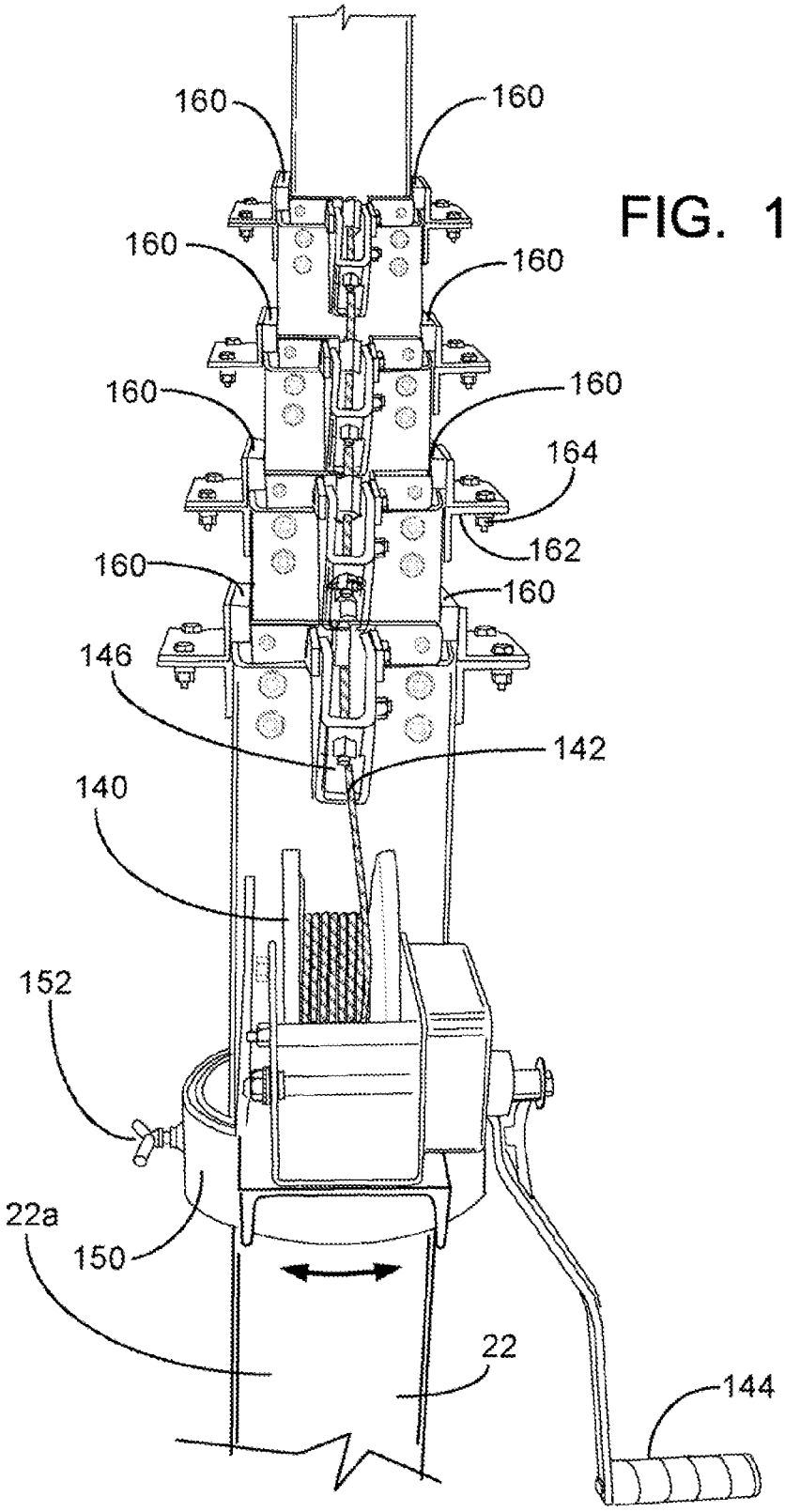
FIG. 14 shows a partial front view of the telescopic mast.

Referring also to FIG. 14, the telescopic light assembly 20 includes a hand winch 140 with a locking break and operating handle 144. The hand winch 140 has wound a galvanized cable 142 coupled to a stainless steel pulley 146 which is mounted on bracket 163 (FIGS. 8 and 9).

Figure 8:
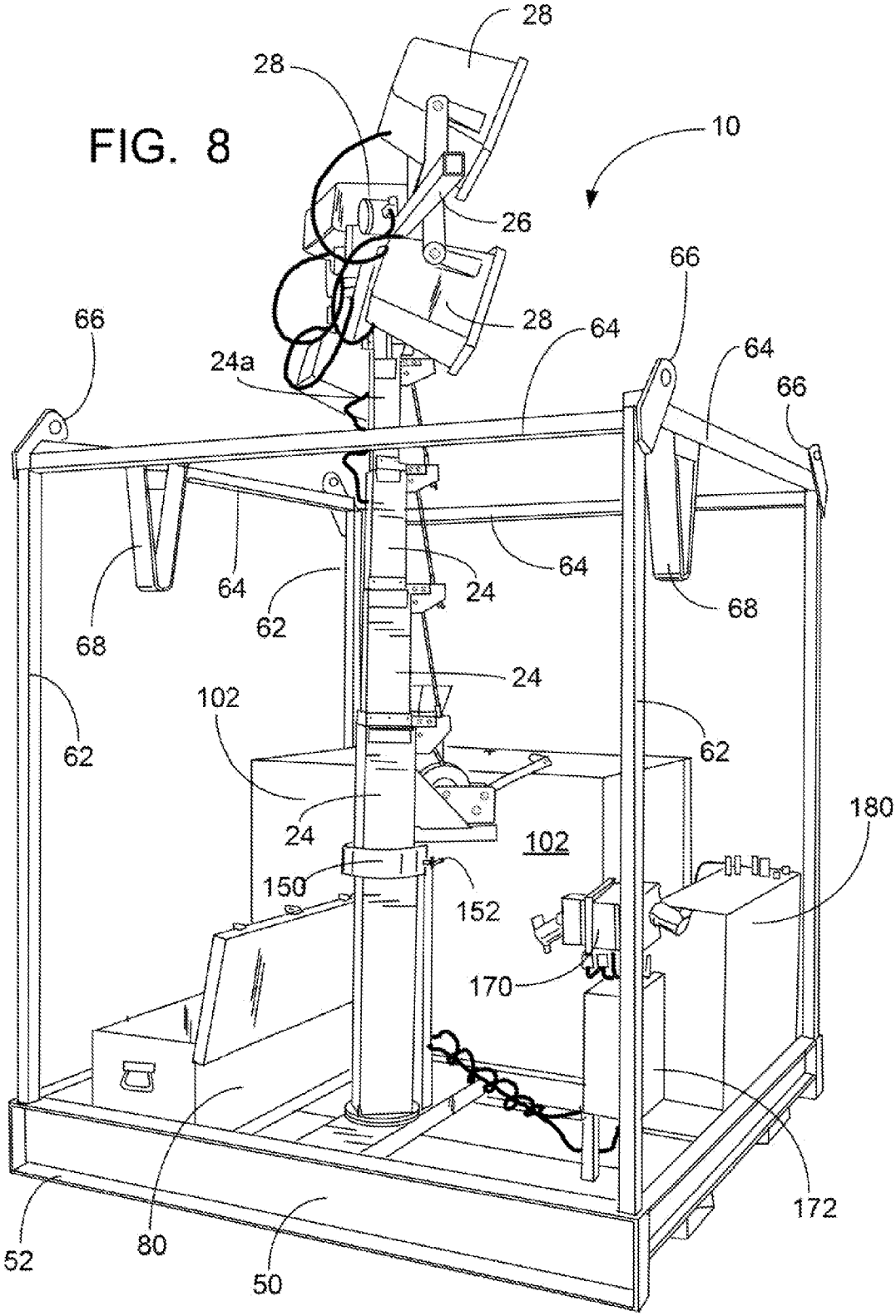
FIG. 8 shows a front view of the easy-guide portable light tower system of the present invention with the telescopic light assembly in an intermediary telescoped position and rotated counter-clock wise.
Figure 9:
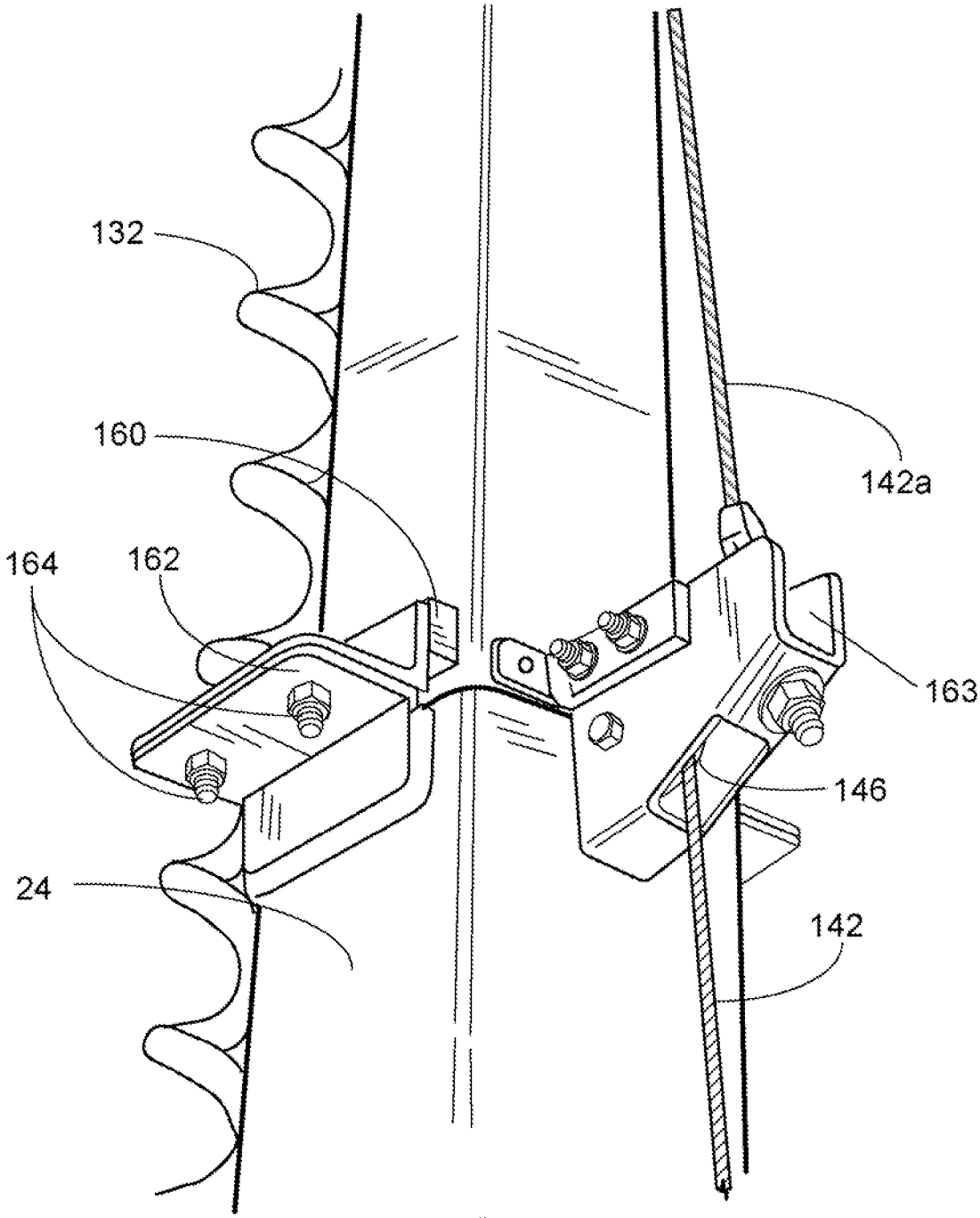
FIG. 9 shows a partial perspective view of the telescopic mast.

Referring to FIGS. 8 and 9, a bracket 163 is attached at a top of each telescoping section 24 (excluding topmost section 24*a*). A stainless steel pulley 146 is mounted to each bracket 163. A separate galvanized cable 146*a*, 146*b* and 146*c* is terminated on one end at each bracket 163. Said cables 146*a*-146*c* are coupled to the pulley 146 attached to the telescoping section adjacent to and above the telescoping section to which each cable is terminally attached.

In the exemplary embodiment, the plurality of lights 28 are arranged in pairs. One pair of lights 28 is on a left arm of the crossbar member 26 while the other pair is supported from the right arm of the crossbar member 26. Each light 28 is adjustably mounted, to the left arm or the right arm, via a bracket 30. In the views, there are four lights 28. Nevertheless, more or less lights may be included.

Figure 4:
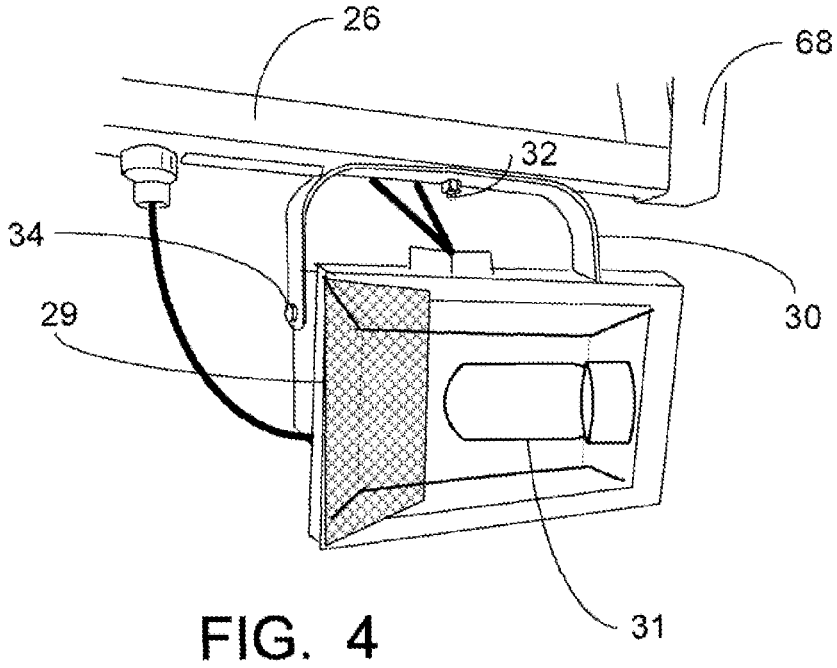
FIG. 4 shows a front view of a light of the telescopic light assembly.

Each of lights 28 may include a metal Halon (Class 1 Div 2) 400 Watt Light with fixture (FIG. 4). The lights 28 further include a retractable cord (not shown) and a circuit breaker protected weatherproof enclosure 29.

The bracket 30 is generally U-shaped and can be adjustably rotated essentially 360° about the arm in the Y-plane and fastened via fastener 32. As the bracket is rotated, the light enclosure 29 is rotated accordingly. The fasteners 34 to fasten the light enclosure 29 to the bracket 30 allows the light enclosure 29 to be adjusted in a 360° rotation about the X-axis while the bracket 30 is stationary or fastened via fastener 32. As can be readily seen, the bracket 30 provides multiple degrees of variability for orienting the lights 28.

The skid 50 has fixedly coupled thereto a top-mounted cage 60. Together the skid 50 and cage 60 form a transport enclosure to protect and carry the telescopic light assembly 20. The skid 50 has a generally box shaped foot print which may be rectangular or square. The skid 50 includes a four-sided perimeter frame structure 52. Each corner of the four-sided perimeter frame structure 52 has fixed mounted thereto a bottom-end of vertical support members 62. The top-end of the vertical support members 62 are strapped or secured together by horizontal support members 64. Free-ends of a horizontal support member 64 are fixedly coupled to two adjacent vertical support members 62.

The skid 50 is made of structural steel all welded and galvanized. The skid 50 includes a beveled Drip Pan with a bottom drain, forklift pockets 53 (FIG. 2), and vibration isolators under the engine/generator sub-assembly 100.

The cage 60 is essentially defined by the vertical support members 62 and the horizontal support members 64. The cage 60 further includes eye pads 66 mounted to or in close proximity to the top-end of the vertical support members 62. The cage 60 of the transport enclosure further includes a pair of stabilizing channels 68, as best seen in FIG. 3, for the telescopic light assembly 20 in the stowed position.

Figure 3:
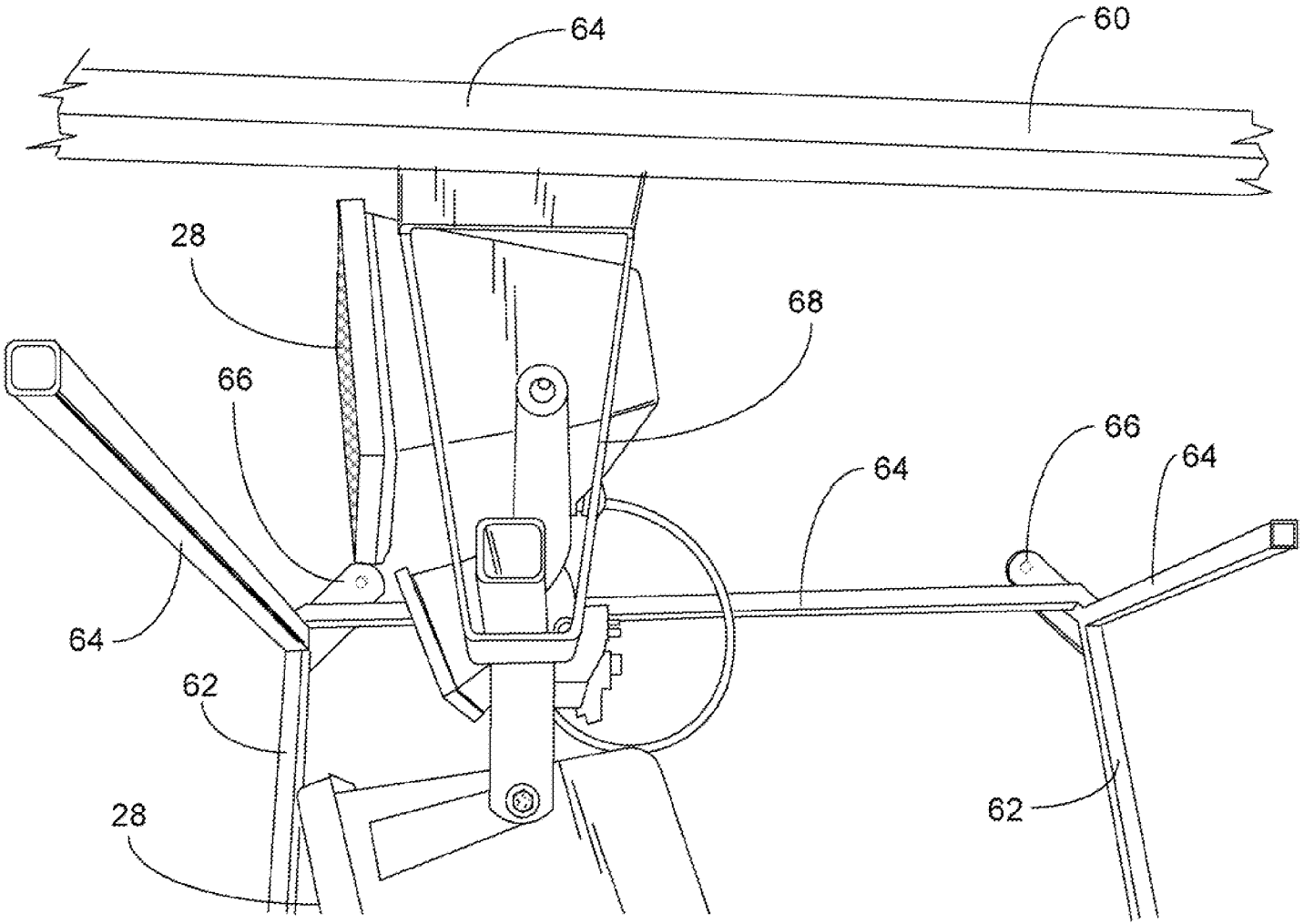
FIG. 3 shows a view of a stabilizing channel for the telescopic light assembly in the stowed position.
Figure 5:
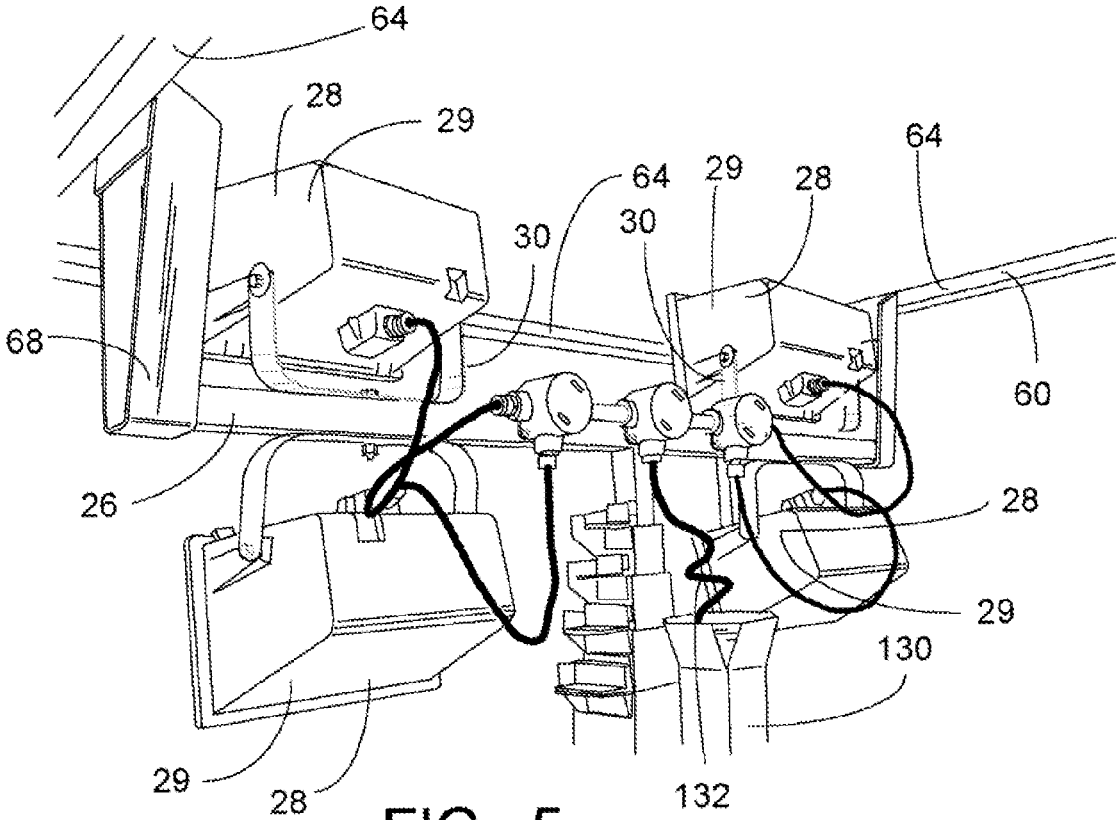
FIG. 5 shows a rear view of the light array of the telescopic light assembly.

Referring now to FIGS. 3 and 5, the stabilizing channel 68 is depicted mounted to a right side of the cage 60. The stabilizing channel 68 by way of example is supported from a right one of the horizontal support member 64. The other stabilizing channel 68 is supported from a left one of the horizontal support members 64. The stabilizing channel 68 provides a guide or channel 68 to store a free end of the crossbar 26 of the telescopic light assembly 20 in the stowed position. The telescopic mast 22 should also be at zero degrees (0°). In the exemplary embodiment, the telescopic light assembly 20 when stowed or being lowered into the transport enclosure, should be at zero degrees (0°) so as not to contact the cage 60. Nevertheless, if the cage 60 was sufficiently larger than the width of the crossbar 26 the telescopic light assembly 20 could be lowered when rotated to a degree other than 0°. However, in such a case, the transport enclosure would be larger.

The stabilizing channel 68 is generally V-shaped. Nevertheless, other shapes may be used. In this embodiment, the width of the lowest end of the stabilizing channel 68 is narrower than the upper end of the stabilizing channel 68. The width of the lowest end of the stabilizing channel 68 limits the movement forward and backward of the free end of the crossbar member 26 or arm thereof.

As can be appreciated, the width and height of the transport enclosure is constructed to fully recess or confine the telescopic light assembly 20 when in the stowed position, as best seen in FIG. 1. In the exemplary embodiment, the width and height of the transport enclosure define the horizontal and vertical perimeter boundaries of the transport enclosure. The horizontal and vertical perimeter boundaries of the transport enclosure closely track (with minimum clearance) the height and width of the telescopic light assembly 20 when in the stowed position such that the telescopic light assembly 20 is fully lowered.

In other words, the transport enclosure is minimized in size so that its size does not take up unnecessary real estate on an oil-field platform or other off-shore structure while also fully enclosing the telescopic light assembly 20.

As can be appreciated during transport, loading and unloading, or when on an off-shore platform or drilling rig, the telescopic light assembly 20 could move as the result of strong impact forces. The stabilizing channels 68 stabilize the left and right light supporting arms defined by the crossbar member 26 when the telescopic light assembly 20 is in a stowed position. Thus, the impact forces articulated to the plurality of lights 28 may be reduced to minimize breakage of the light bulbs 31 (FIG. 4).

Referring again to FIGS. 1 and 6, the left side of the easy-guide portable light tower system 10 includes a storage box 80 having an enclosure 82 closed via lid 84. The storage box 80 is mounted on the skid 50. One side of the storage box 80 is hingedly coupled to the enclosure 82. The other side of the lid 84 is adapted to be held closed via at least one latching or locking member 86. In general, the storage box 80 is similar to a tool box. The storage box 80 is made of a non-corrosive metal such as without limitation aluminum.

Figure 12:
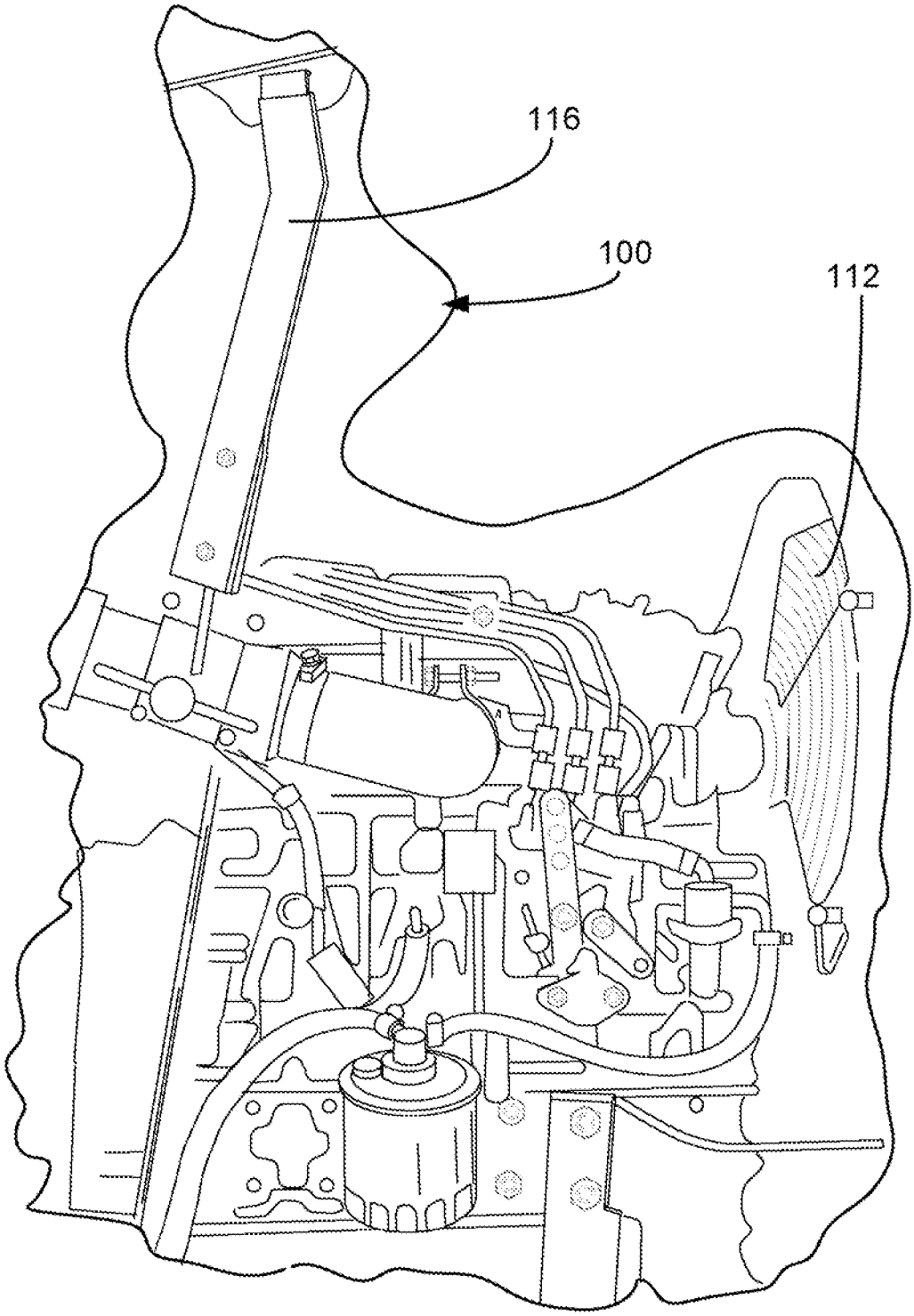
FIG. 12 shows an engine/generator system and radiator.
Figure 13:
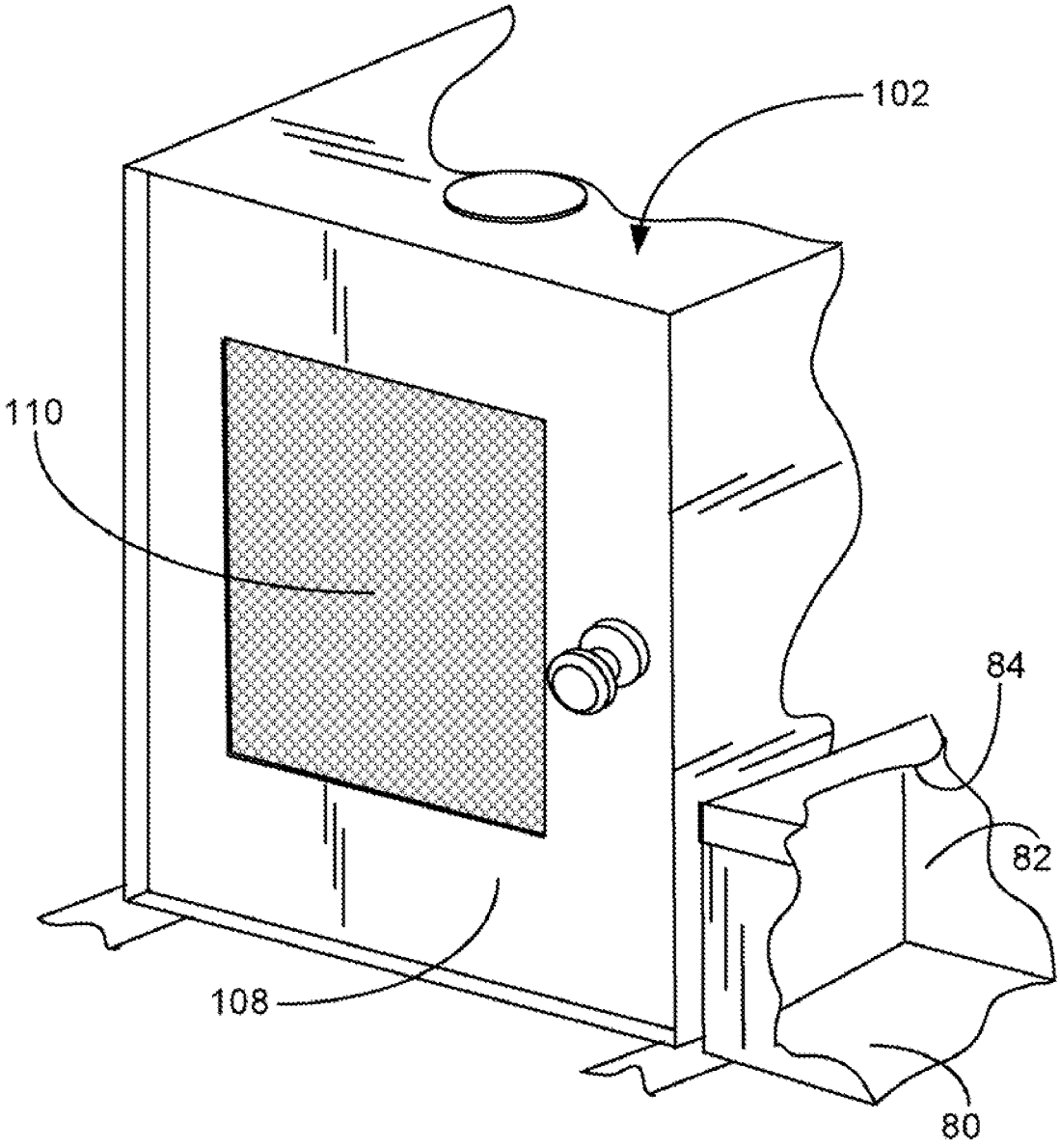
FIG. 13 shows a partial side view of the engine/generator housing and storage box.

With specific reference to FIGS. 10, 12, 13 and 16, the engine/generator assembly 100 is housed in an engine/generator housing 102. The rear of the housing 102 has a plurality of access panels 104 and 106. The left side of the housing 102 includes a door 108 having a vent 110 formed therein. In the housing 102 adjacent the door 108 is a radiator 112. FIGS. 12 and 13 illustrate the engine/generator sub-assembly 100 and various components thereof.

In the exemplary embodiment, the engine is a Kubota Diesel Engine which is three-cylinder liquid cooled (14 hp @ 1800 rpm). The engine has a mounted radiator 112, a coolant recovery tank, an air cleaner, a manual air intake shutdown 116 (FIG. 12), and a muffler. As best seen in FIG. 1, the top of housing 102 has an emergency shutdown handle 116*a* to shutdown the air intake. Furthermore, the engine includes a spark arrestor, a 12 volt electric start, a secondary fuel filter, an electric fuel pump with a primary Racor fuel filter, F.W. Murphy Engine Controls, Hi Temp/Low Oil Shutdown, Hour Meter, and an EZ oil drain valve.

The generator of the exemplary embodiment is manufactured by Newage. The generator produces 8 KW. The generator includes a dedicated single phase, 4-Pole, Single Bearing system. The generator operates at 1800 rpm, 120/240V. The generator is AC Brushless and is epoxy coated. The generator has an automatic voltage regulator, self excited, dynamically balanced rotor, and is fan cooled. The engine and generator above are just examples of suitable engines and generators and may be substituted with similar devices of other manufacturers.

Figure 10:
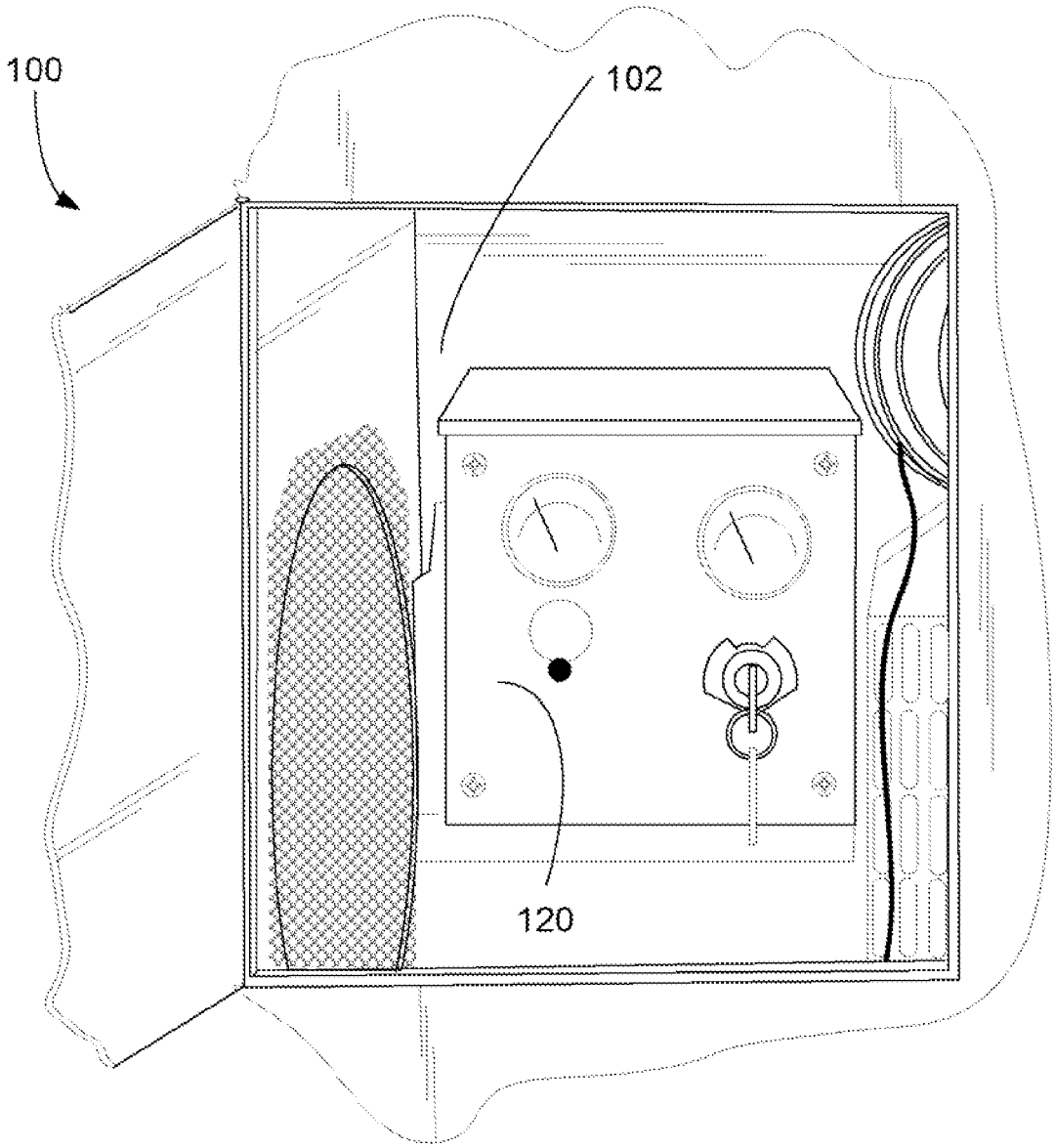
FIG. 10 shows a control panel inside an engine/generator housing.
Figure 11:
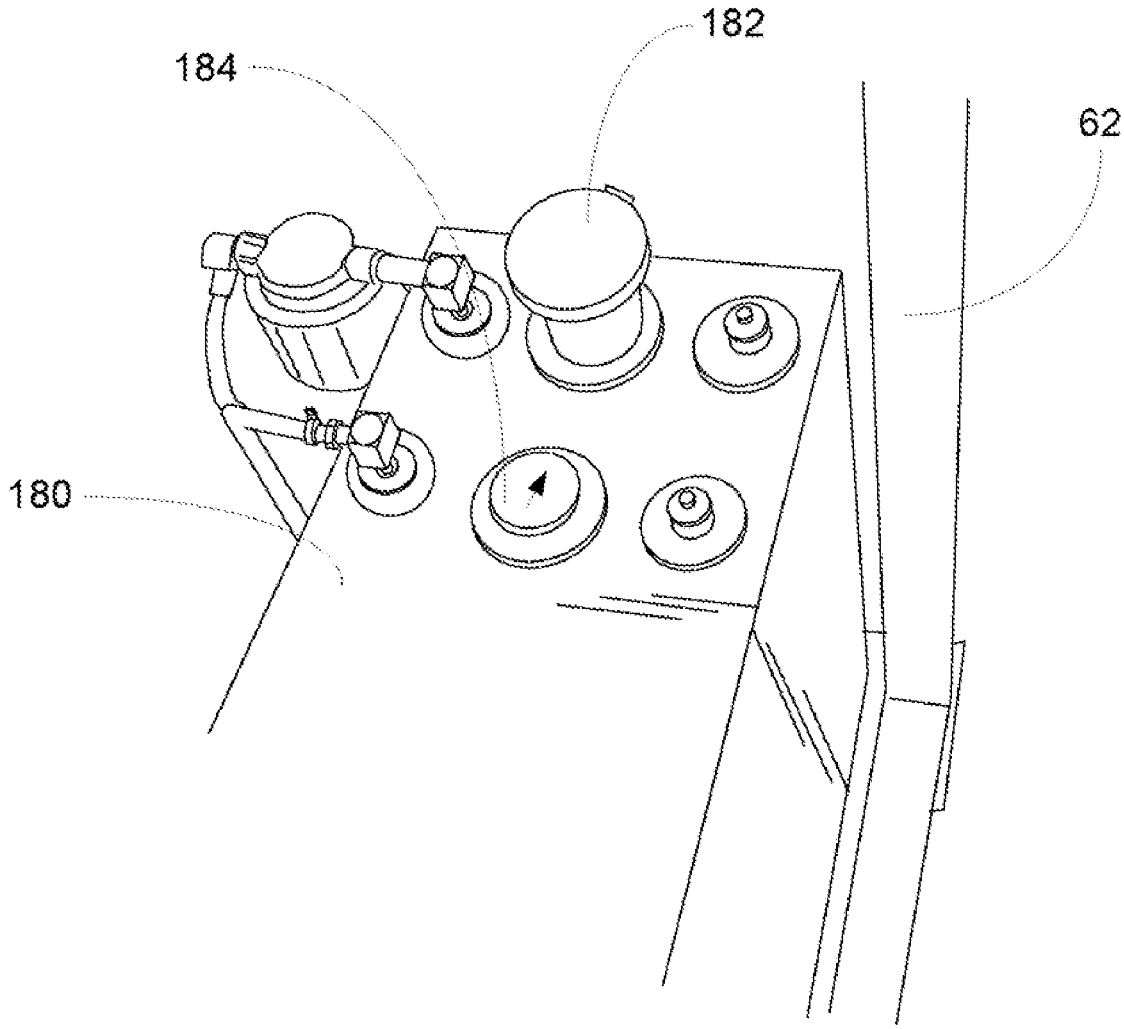
FIG. 11 shows a top of a fuel tank with a gauge.

FIG. 10 shows a control panel 120 accessed through the access panel 104. FIG. 11 illustrates a top view of the fuel tank 180. The fuel tank 180 stores the fuel for operating the engine/generator sub-assembly 100. The top of the fuel tank 180 includes a removable cap 182 for refilling the fuel tank 180. The fuel tank 180 also includes a fuel gauge 184. By way of example, the fuel tank 180 holds 30 Gallons and is a C.G. (Coast Guard) Approved Fuel Tank with a bottom drain.

FIG. 2 shows a (right) side view of the easy-guide portable light tower system 10 of FIG. 1. FIGS. 3 and 5 show views of the telescopic light assembly 20 in the stowed position. With reference to FIGS. 5 and 7, the easy-guide portable light tower system 10 further includes an electric cable feed chamber 130 parallel and behind the telescopic mast 22 of the telescopic light assembly 20. The electrical cable feed chamber 130 houses (stores) and protects the electric cable 132 therein. The electric cable 132 provides power to the plurality of lights 28. The electrical cable 132 is shown having a coiled or spiraling profile. Under gravity, the electric cable 132 is automatically stowed in and dispensed from the electric cable feed chamber 130.

Gravity and/or the coiled properties of the electric cable 132 allow the cable 132 to automatically fall or re-coil in the electric cable feed chamber 130. This feature eliminates loose cable wires from just hanging around on the skid 50 or on other structures. Thus, the electric cable 132 has less chances of being tangled when the telescopic mast 22 is raised. This also eliminates other entanglement of the electric cable 132 since it is neatly stowed in the electric cable feed chamber 130.

FIG. 7 shows a rear view of the easy-guide portable light tower system 10 of the present invention with the telescopic light assembly 20 in a fully telescoped position. The coiled electric cable 132 is pulled from the electric cable feed chamber 130 as the telescopic mast 22 is raised or telescoped. As the telescopic light assembly 20 is lowered, the coiled electric cable 132 is automatically filled or recoiled in the electric cable feed chamber 130.

FIG. 6 shows a front view of the easy-guide portable light tower system 10 of the present invention with the telescopic light assembly 20 in a fully telescoped position. FIG. 8 shows a front view of the easy-guide portable light tower system 10 of the present invention with the telescopic light assembly 20 in an intermediary telescoped position and rotated counter-clock wise.

With specific reference to FIGS. 8 and 14, the telescopic mast 22 includes a band 150 with a locking pin 152. The locking pin 152 locks the telescopic mast 22 to a particular degree of rotation in the Y-plane. In FIG. 1, the degree of rotation is 0°. FIG. 8 illustrates other degrees of rotation at which the telescopic mast 22 can be locked.

In operation, the telescopic mast 22 is telescoped or raised by rotating the winch handle 144. As handle 144 is rotated, each mast section 24 is raised an equivalent amount, the cables 142*a*-142*c* being held in tension as the sections are raised. (FIGS. 8 and 9). Thus, various heights can be achieved. In the exemplary embodiment, the maximum height is 16 feet. However, other heights can be achieved with different lengths of the telescoping sections 24.

Figure 15:
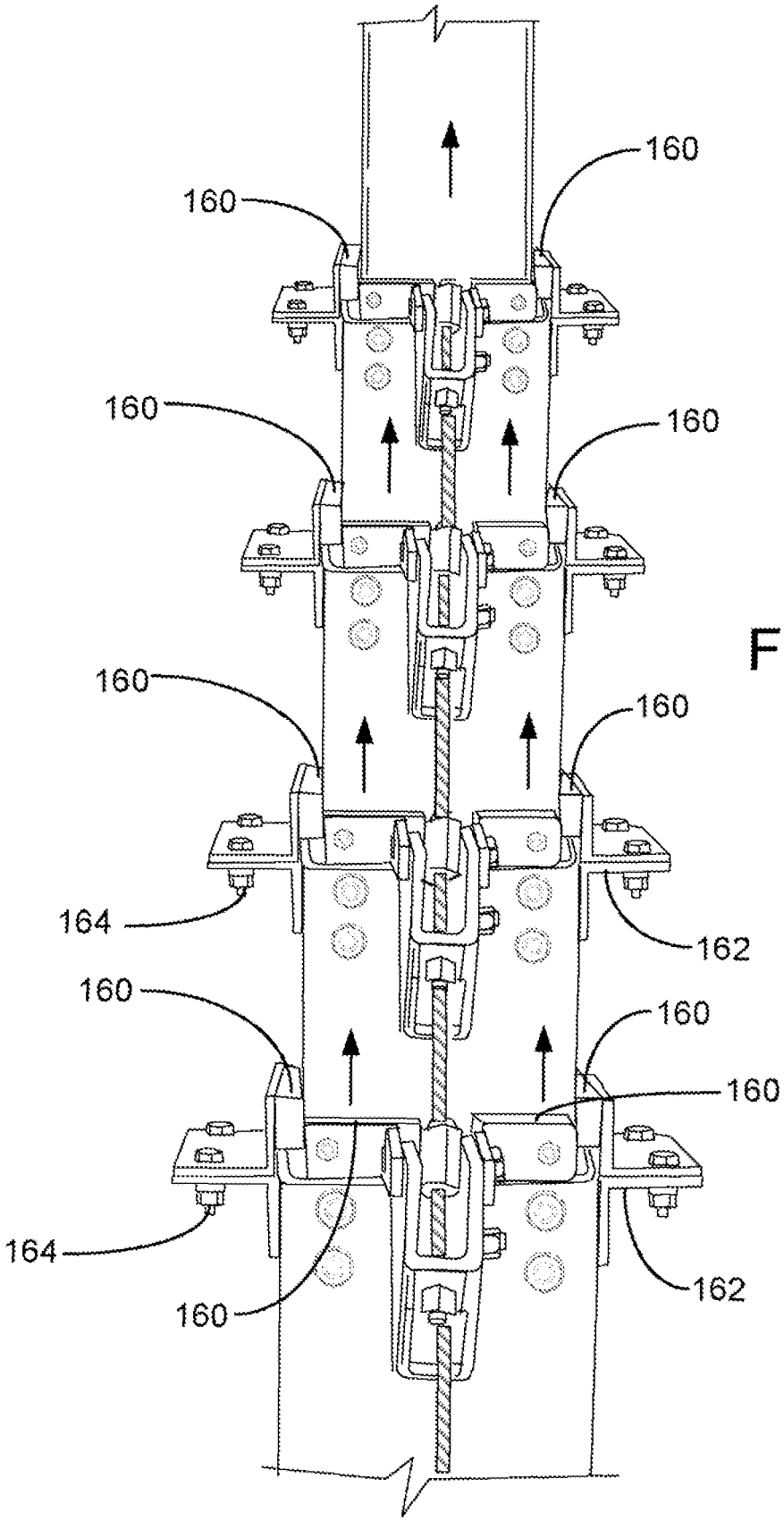
FIG. 15 shows a partial front view of the plurality of telescoping sections.
Figure 16:
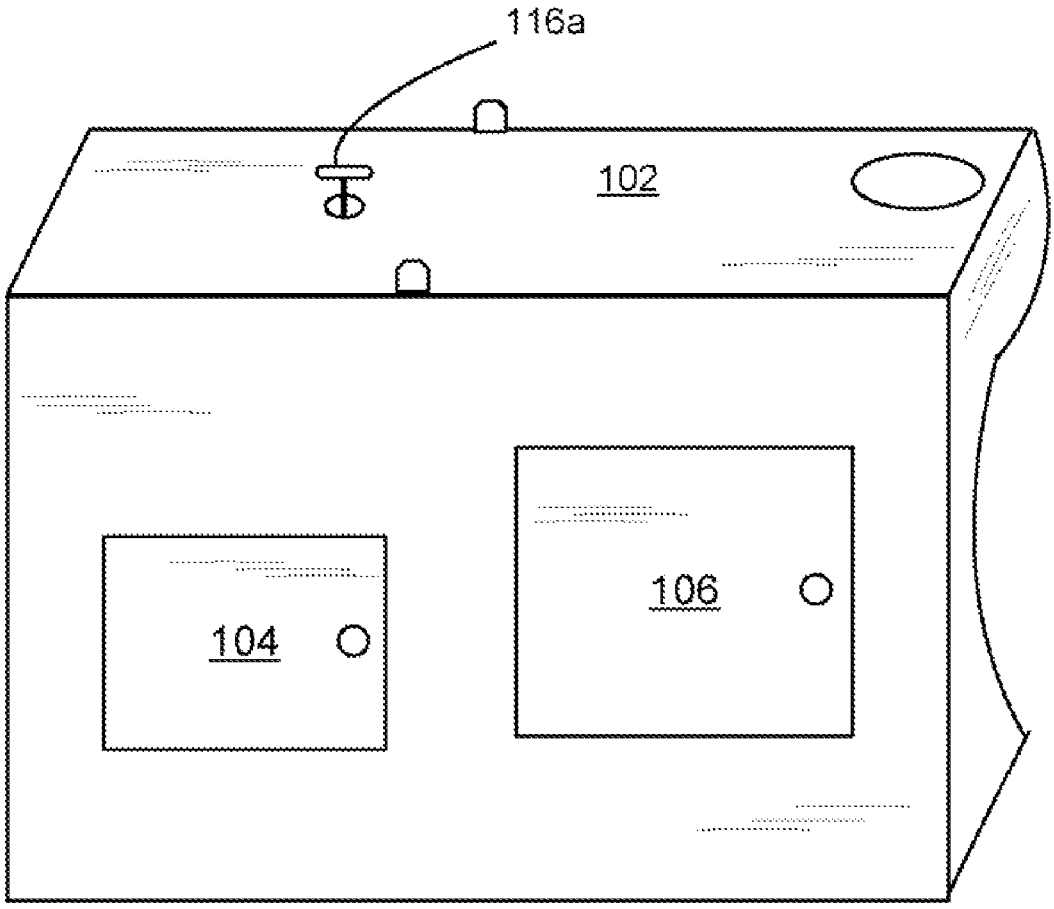
FIG. 16 shows a partial rear view of the engine/generator housing

Referring now to FIGS. 9, 14 and 15, the top of the mast base 22*a* and the top of the intermediate telescoping sections 24 each have a plurality of pads 160 to create a frictionless surface between two adjacent and concentric telescoping sections 24 or mast base 22*a*. Each pad 160 is removably coupled to a bracket 162 via fasteners 164. The brackets 162 are secured to the top end of the mast base 22*a* and the intermediate telescoping sections 24. At least three sides of the sections 24 have a bracket associated therewith. Each bracket has a pad 160.

In the exemplary embodiment, the plurality of frictionless surfaces or pads 160 are made of Teflon, Graphite or the like. Thus, a frictionless surface is created without the need for oil or other lubricants.

In FIGS. 1 and 2, a switch panel 172 is positioned below the power outlets 170 to turn on and off the outlets 170. The switch panel 172 is shown behind the partially removed door. (FIG. 2). The bank of outlets 170 includes at least one emergency shutoff switch 174. In the exemplary embodiment, two emergency shutoff switches 174 are provided. The outlets 170 are split between the two switches 174. Nevertheless, other configurations may be used. In the exemplary embodiment, all of the outlets 170 are 110V. However, other voltages may be used.

The power outlets 170 include 110V Explosion Proof Receptacles (Class 1 & 2), circuit breaker protected.

In the exemplary embodiment, the dimensions of the transport enclosure is approximately L 72"×W 72"×H 85" with a dry weight of approximately 2200 lbs. The telescopic light assembly 20 is mounted to the transport enclosure and is operable to telescope vertically to extend beyond the vertical perimeter boundary or height. Moreover, the telescopic light assembly 20, when stowed, is fully recessed and confined in the transport enclosure within the vertical and horizontal perimeter boundaries defined by the height H and width W.

The system 10 is preferably made of the highest quality components available. It is designed in form and function to meet offshore duty requirements. The skid design insures protection to all components. The engine/generator sub-assembly 100 is rated for continuous duty operation. The mast and transport enclosure are preferably made of galvanized steel. Nevertheless other non-corrosive metals such as without limitation aluminum may be used. The mast is made of 3/16" square tubes.

The housing 102 and fuel tank 180 are also made of non-corrosive metals.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A system comprising:

a transport enclosure constructed and arranged for an off-shore environment and having a horizontal perimeter boundary and a vertical perimeter boundary; and a telescopic light assembly mounted to the transport enclosure and operable to telescope vertically to extend beyond the vertical perimeter boundary and which when stowed is fully recessed and confined in the transport enclosure within the vertical and horizontal perimeter boundaries wherein the telescopic light assembly comprises:

a telescopic mast;

a crossbar perpendicularly coupled about a center thereof to a top end of the telescopic mast forming left and right arms; and a plurality of lights coupled to the left and right arms.

2. The system of claim 1, wherein the transport enclosure comprises:

a skid; and a cage with vertical support members and horizontal support members, wherein lower ends of the vertical support members are coupled to corners of the skid and the horizontal support members are coupled to top ends of the vertical support members; and stabilizing channels supported from two parallel horizontal support members in proximity to receive free ends of the left and right arms when the mast is essentially at zero degrees.

3. The system of claim 1, wherein the telescopic mast is adapted to be rotated in a Y-plane.

4. The system of claim 1, wherein the telescopic mast comprises a plurality of concentric telescoping sections, wherein a top of each telescoping section has a plurality of pads to create a frictionless surface between two adjacent telescoping sections.

5. The system of claim 1, wherein the telescopic mast comprises a plurality of concentric telescoping sections, wherein a top of each telescoping section has a plurality of frictionless surfaces between two adjacent telescoping sections.

6. The system of claim 5, wherein the plurality of frictionless surfaces includes Teflon.

7. The system of claim 5, wherein the plurality of frictionless surfaces are oil or lubricant free.

8. The system of claim 5, wherein the plurality of frictionless surfaces includes at least one of Teflon and Graphite.

9. The system of claim 5, wherein the plurality of frictionless surfaces includes removable pads made of at least one of Teflon and Graphite.

10. The system of claim 1, wherein the telescopic light assembly is directly mounted to the transport enclosure in a vertically upright position and is stowed in the vertically upright position.

11. The system of claim 1, wherein the telescopic light assembly is directly mounted, swivelly, to a skid of the transport enclosure.

12. The system of claim 1, further comprising a bank of receptacles constructed for the off-shore environment and mounted to the transport enclosure.

13. The system of claim 1, further comprising:

an engine/generator; and a housing mounted within the transport enclosure to house the engine/generator.

14. The system of claim 13, further comprising a fuel tank mounted within the transport enclosure.

15. The system of claim 14, wherein the fuel tank is mounted immediately adjacent to the housing of the engine/generator.

16. The system of claim 1, wherein the transport enclosure includes an electric cable chamber which stores a coiled electric cable which delivers power to the plurality of lights of the telescopic light assembly, the electric cable chamber is arranged to automatically dispense therefrom and receive therein the electric cable.

17. The system of claim 1, wherein the telescopic mast comprises a plurality of concentric telescoping sections, wherein a top of each telescoping section has a plurality of frictionless surfaces between two adjacent telescoping sections; and further comprising: a hand winch and operating handle coupled to the telescopic mast and a galvanized cable with stainless steel pulleys, wherein the galvanized cable and stainless steel pulleys are coupled to the plurality of concentric telescoping sections to raise or lower the plurality of concentric telescoping sections as the hand winch is rotated to wind or unwind the galvanized cable.

18. A system comprising:

means for illuminating;

means for telescoping vertically the illuminating means;

means coupled to the telescoping means for easy gliding vertical extension of the telescoping means;

means for transporting and enclosing the telescoping means fully within a horizontal perimeter boundary and a vertical perimeter boundary thereof; and means for supporting the illuminating means to a left and right of a top and center of the telescoping means;

wherein the telescoping means comprises a plurality of concentric telescoping sections, wherein a top of each telescoping section has a plurality of pads to create a frictionless surface between two adjacent telescoping sections.

19. The system of claim 18, wherein the transporting and enclosing means comprises: means for caging the telescoping means and the illuminating means; and means, coupled to the caging means, for stabilizing the illuminating means on the left and right.

20. The system of claim 18, wherein the telescoping means includes means for rotating the telescoping means in a Y-plane.

21. The system of claim 18, wherein the plurality of pads includes Teflon.

22. The system of claim 18, wherein the plurality of pads are oil or lubricant free.

23. The system of claim 21, wherein the plurality of pads includes at least one of Teflon and Graphite.

24. The system of claim 21, wherein the plurality of pads includes removable pads made of at least one of Teflon and Graphite.

25. A system comprising:

means for illuminating;

means for telescoping vertically the illuminating means;

means coupled to the telescoping means for easy gliding vertical extension of the telescoping means;

means for transporting and enclosing the telescoping means fully within a horizontal perimeter boundary and a vertical perimeter boundary thereof; and means for supporting the illuminating means to a left and right of a top and center of the telescoping means, further comprising means for directly mounting and stowing the telescoping means to the transporting and enclosing means in a vertically upright position.

26. The system of claim 25, wherein the mounting means includes means for swiveling the telescoping means clockwise or counter-clockwise relative to the transporting and enclosing means.

27. The system of claim 18, further comprising a bank of receptacles constructed for an off-shore environment and being mounted to the transporting and enclosing means.

28. A system comprising:

means for illuminating;

means for telescoping vertically the illuminating means;

means coupled to the telescoping means for easy gliding vertical extension of the telescoping means;

means for transporting and enclosing the telescoping means fully within a horizontal perimeter boundary and a vertical perimeter boundary thereof; and means for supporting the illuminating means to a left and right of a top and center of the telescoping means, further comprising: means for generating power; and means, coupled to the transporting and enclosing means, for housing the power generating means.

29. The system of claim 28, further comprising means, coupled to the transporting and enclosing means, for storing fuel.

30. The system of claim 18, further comprising means for automatically storing and dispensing an electrical cable, the electrical cable delivering power to the illuminating means.

31. A system comprising:

a transport enclosure constructed and arranged for an off-shore environment and having a horizontal perimeter boundary and a vertical perimeter boundary; and a telescopic light assembly mounted to the transport enclosure and operable to telescope vertically to extend beyond the vertical perimeter boundary and which when stowed is fully recessed and confined in the transport enclosure within the vertical and horizontal perimeter boundaries wherein the telescopic light assembly is directly mounted, swivelly, to a skid of the transport enclosure.

32. The system of claim 31, wherein the telescopic light assembly comprises:

a telescopic mast;

a crossbar perpendicularly coupled about a center thereof to a top end of the telescopic mast forming left and right arms; and a plurality of lights coupled to the left and right arms.

33. The system of claim 32, wherein the transport enclosure comprises:

a skid;

a cage with vertical support members and horizontal support members, wherein lower ends of the vertical support members are coupled to corners of the skid and the horizontal support members are coupled to top ends of the vertical support members; and stabilizing channels supported from two parallel horizontal support members in proximity to receive free ends of the left and right arms when the mast is essentially at zero degrees.

34. The system of claim 32, wherein the telescopic mast is adapted to be rotated in a Y-plane.

35. The system of claim 32, wherein the telescopic mast comprises a plurality of concentric telescoping sections, wherein a top of each telescoping section has a plurality of pads to create a frictionless surface between two adjacent telescoping sections.

36. The system of claim 32, wherein the telescopic mast comprises a plurality of concentric telescoping sections, wherein a top of each telescoping section has a plurality of frictionless surfaces between two adjacent telescoping sections.

37. The system of claim 36, wherein the plurality of frictionless surfaces includes Teflon.

38. The system of claim 36, wherein the plurality of frictionless surfaces are oil or lubricant free.

39. The system of claim 36, wherein the plurality of frictionless surfaces includes at least one of Teflon and Graphite.

40. The system of claim 36, wherein the plurality of frictionless surfaces includes removable pads made of at least one of Teflon and Graphite.

41. The system of claim 31, wherein the telescopic light assembly is directly mounted to the transport enclosure in a vertically upright position and is stowed in the vertically upright position.

42. The system of claim 31, further comprising a bank of receptacles constructed for the off-shore environment and mounted to the transport enclosure.

43. The system of claim 31, further comprising:

an engine/generator; and a housing mounted within the transport enclosure to house the engine/generator.

44. The system of claim 43, further comprising a fuel tank mounted within the transport enclosure.

45. The system of claim 44, wherein the fuel tank is mounted immediately adjacent to the housing of the engine/generator.

46. The system of claim 31, wherein the transport enclosure includes an electric cable chamber which stores a coiled electric cable which delivers power to lights of the telescopic light assembly, the electric cable chamber is arranged to automatically dispense therefrom and receive therein the electric cable.

47. The system of claim 34, wherein the telescopic mast comprises a plurality of concentric telescoping sections, wherein a top of each telescoping section has a plurality of frictionless surfaces between two adjacent telescoping sections; and further comprising: a hand winch and operating handle coupled to the telescopic mast and a galvanized cable with stainless steel pulleys, wherein the galvanized cable and stainless steel pulleys are coupled to the plurality of concentric telescoping sections to raise or lower the plurality of concentric telescoping sections as the hand winch is rotated to wind or unwind the galvanized cable.

48. A system comprising:

a transport enclosure constructed and arranged for an off-shore environment and having a horizontal perimeter boundary and a vertical perimeter boundary;

a telescopic light assembly mounted to the transport enclosure and operable to telescopic vertically to extend beyond the vertical perimeter boundary and which when stowed is fully recessed and confined in the transport enclosure within the vertical and horizontal perimeter boundaries; and a bank of receptacles constructed for the off-shore environment and mounted to the transport encloser;

wherein the telescopic light assembly comprises:

a telescopic mast;

a crossbar perpendicularly coupled about a center thereof to a top end of the telescopic mast forming left and right arms; and a plurality of lights coupled to the left and right arms.

49. The system of claim 48, wherein the transport enclosure comprises:

a skid;

a cage with vertical support members and horizontal support members, wherein lower ends of the vertical support members are coupled to corners of the skid and the horizontal support members are coupled to top ends of the vertical support members; and stabilizing channels supported from two parallel horizontal support members in proximity to receive free ends of the left and right arms when the mast is essentially at zero degrees.

50. The system of claim 48, wherein the telescopic mast is adapted to be rotated in a Y-plane.

51. The system of claim 48, wherein the telescopic mast comprises a plurality of concentric telescoping sections, wherein a top of each telescoping section has a plurality of pads to create a frictionless surface between two adjacent telescoping sections.

52. The system of claim 48, wherein the telescopic mast comprises a plurality of concentric telescoping sections, wherein a top of each telescoping section has a plurality of frictionless surfaces between two adjacent telescoping sections.

53. The system of claim 52, wherein the plurality of frictionless surfaces includes Teflon.

54. The system of claim 52, wherein the plurality of frictionless surfaces are oil or lubricant free.

55. The system of claim 52, wherein the plurality of frictionless surfaces includes at least one of Teflon and Graphite.

56. The system of claim 52, wherein the plurality of frictionless surfaces includes removable pads made of at least one of Teflon and Graphite.

57. A system comprising:

a transport enclosure constructed and arranged for an off-shore environment and having a horizontal perimeter boundary and a vertical perimeter boundary;

a telescopic light assembly mounted to the transport enclosure and operable to telescope vertically to extend beyond the vertical perimeter boundary and which when stowed is fully recessed and confined in the transport enclosure within the vertical and horizontal perimeter boundaries; and a bank of receptacles constructed for the off-shore environment and mounted to the transport enclosure;

wherein the telescopic light assembly is directly mounted to the transport enclosure in a vertically upright position and is stowed in the vertically upright position.

58. A system comprising:

a transport enclosure constructed and arranged for an off-shore environment and having a horizontal perimeter boundary and a vertical perimeter boundary;

a telescopic light assembly mounted to the transport enclosure and operable to telescope vertically to extend beyond the vertical perimeter boundary and which when stowed is fully recessed and confined in the transport enclosure within the vertical and horizontal perimeter boundaries; and a bank of receptacles constructed for the off-shore environment and mounted to the transport enclosure;

wherein the telescopic light assembly is directly mounted, swivelly, to a skid of the transport enclosure.

59. A system comprising:

a transport enclosure constructed and arranged for an off-shore environment and having a horizontal perimeter boundary and a vertical perimeter boundary;

a telescopic light assembly mounted to the transport enclosure and operable to telescope vertically to extend beyond the vertical perimeter boundary and which when stowed is fully recessed and confined in the transport enclosure within the vertical and horizontal perimeter boundaries; and a bank of receptacles constructed for the off-shore environment and mounted to the transport enclosure;

further comprising:

an engine/generator; and a housing mounted within the transport enclosure to house the engine/generator.

60. The system of claim 59, further comprising a fuel tank mounted within the transport enclosure.

61. The system of claim 60, wherein the fuel tank is mounted immediately adjacent to the housing of the engine/generator.

62. The system of claim 48, wherein the transport enclosure includes an electric cable chamber which stores a coiled electric cable which delivers power to lights of the telescopic light assembly, the electric cable chamber is arranged to automatically dispense therefrom and receive therein the electric cable.

63. The system of claim 48, wherein the telescopic mast comprises a plurality of concentric telescoping sections, wherein a top of each telescoping section has a plurality of frictionless surfaces between two adjacent telescoping sections; and further comprising: a hand winch and operating handle coupled to the telescopic mast and a galvanized cable with stainless steel pulleys, wherein the galvanized cable and stainless steel pulleys are coupled to the plurality of concentric telescoping sections to raise or lower the plurality of concentric telescoping sections as the hand winch is rotated to wind or unwind the galvanized cable.

64. A system comprising:

a transport enclosure constructed and arranged for an off-shore environment and having a horizontal perimeter boundary and a vertical perimeter boundary;

a telescopic light assembly mounted to the transport enclosure and operable to telescope vertically to extend beyond the vertical perimeter boundary and which when stowed is fully recessed and confined in the transport enclosure within the vertical and horizontal perimeter boundaries;

an engine/generator; and a housing mounted within the transport enclosure to house the engine/generator.

65. The system of claim 64, wherein the telescopic light assembly comprises:

a telescopic mast;

a crossbar perpendicularly coupled about a center thereof to a top end of the telescopic mast forming left and right arms; and a plurality of lights coupled to the left and right arms.

66. The system of claim 65, wherein the transport enclosure comprises:

a skid;

a cage with vertical support members and horizontal support members, wherein lower ends of the vertical support members are coupled to corners of the skid and the horizontal support members are coupled to top ends of the vertical support members; and stabilizing channels supported from two parallel horizontal support members in proximity to receive free ends of the left and right arms when the mast is essentially at zero degrees.

67. The system of claim 65, wherein the telescopic mast is adapted to be rotated in a Y-plane.

68. The system of claim 65, wherein the telescopic mast comprises a plurality of concentric telescoping sections, wherein a top of each telescoping section has a plurality of pads to create a frictionless surface between two adjacent telescoping sections.

69. The system of claim 65, wherein the telescopic mast comprises a plurality of concentric telescoping sections, wherein a top of each telescoping section has a plurality of frictionless surfaces between two adjacent telescoping sections.

70. The system of claim 69, wherein the plurality of frictionless surfaces includes Teflon.

71. The system of claim 69, wherein the plurality of frictionless surfaces are oil or lubricant free.

72. The system of claim 69, wherein the plurality of frictionless surfaces includes at least one of Teflon and Graphite.

73. The system of claim 69, wherein the plurality of frictionless surfaces includes removable pads made of at least one of Teflon and Graphite.

74. The system of claim 64, wherein the telescopic light assembly is directly mounted to the transport enclosure in a vertically upright position and is stowed in the vertically upright position.

75. The system of claim 64, wherein the telescopic light assembly is directly mounted, swivelly, to a skid of the transport enclosure.

76. The system of claim 64, further comprising a bank of receptacles constructed for the off-shore environment and mounted to the transport enclosure.

77. The system of claim 64, further comprising a fuel tank mounted within the transport enclosure.

78. The system of claim 77, wherein the fuel tank is mounted immediately adjacent to the housing of the engine/generator.

79. The system of claim 64, wherein the transport enclosure includes an electric cable chamber which stores a coiled electric cable which delivers power to lights of the telescopic light assembly, the electric cable chamber is arranged to automatically dispense therefrom and receive therein the electric cable.

80. The system of claim 65, wherein the telescopic mast comprises a plurality of concentric telescoping sections, wherein a top of each telescoping section has a plurality of frictionless surfaces between two adjacent telescoping sections; and further comprising: a hand winch and operating handle coupled to the telescopic mast and a galvanized cable with stainless steel pulleys, wherein the galvanized cable and stainless steel pulleys are coupled to the plurality of concentric telescoping sections to raise or lower the plurality of concentric telescoping sections as the hand winch is rotated to wind or unwind the galvanized cable.

81. A system comprising:

a transport enclosure constructed and arranged for an off-shore environment and having a horizontal perimeter boundary and a vertical perimeter boundary;

a telescopic light assembly having a telescopic mast mounted to the transport enclosure and operable to telescope vertically to extend beyond the vertical perimeter boundary and which when stowed is fully recessed and confined in the transport enclosure within the vertical and horizontal perimeter boundaries wherein the telescopic mast comprises a plurality of concentric telescoping sections, wherein a top of each telescoping section has a plurality of frictionless surfaces between two adjacent telescoping sections; and further comprising: a hand winch and operating handle coupled to the telescopic mast and a galvanized cable with stainless steel pulleys, wherein the galvanized cable and stainless steel pulleys are coupled to the plurality of concentric telescoping sections to raise or lower the plurality of concentric telescoping sections as the hand winch is rotated to wind or unwind the galvanized cable.

82. The system of claim 81, wherein the telescopic light assembly further comprises:

a crossbar perpendicularly coupled about a center thereof to a top end of the telescopic mast forming left and right arms; and a plurality of lights coupled to the left and right arms.

83. The system of claim 70, wherein the transport enclosure comprises:

a skid; and a cage with vertical support members and horizontal support members, wherein lower ends of the vertical support members are coupled to corners of the skid and the horizontal support members are coupled to top ends of the vertical support members; and stabilizing channels supported from two parallel horizontal support members in proximity to receive free ends of the left and right arms when the mast is essentially at zero degrees.

84. The system of claim 82, wherein the telescopic mast is adapted to be rotated in a Y-plane.

85. The system of claim 82, wherein the telescopic mast comprises a plurality of concentric telescoping sections, wherein a top of each telescoping section has a plurality of pads to create a frictionless surface between two adjacent telescoping sections.

86. The system of claim 82, wherein the telescopic mast comprises a plurality of concentric telescoping sections, wherein a top of each telescoping section has the plurality of frictionless surfaces between two adjacent telescoping sections.

87. The system of claim 86, wherein the plurality of frictionless surfaces includes Teflon.

88. The system of claim 86, wherein the plurality of frictionless surfaces are oil or lubricant free.

89. The system of claim 86, wherein the plurality of frictionless surfaces includes at least one of Teflon and Graphite.

90. The system of claim 86, wherein the plurality of frictionless surfaces includes removable pads made of at least one of Teflon and Graphite.

91. The system of claim 81, wherein the telescopic light assembly is directly mounted to the transport enclosure in a vertically upright position and is stowed in the vertically upright position.

92. The system of claim 81, wherein the telescopic light assembly is directly mounted, swivelly, to a skid of the transport enclosure.

93. The system of claim 81, further comprising a bank of receptacles constructed for the off-shore environment mounted to the transport enclosure.

94. The system of claim 81, further comprising:

an engine/generator; and a housing mounted within the transport enclosure to house the engine/generator.

95. The system of claim 94, further comprising a fuel tank mounted within the transport enclosure,

96. The system of claim 95, wherein the fuel tank is mounted immediately adjacent to the housing of the engine/generator.

97. The system of claim 81, wherein the transport enclosure includes an electric cable chamber which stores a coiled electric cable which delivers power to lights of the telescopic light assembly, the electric cable chamber is arranged to automatically dispense therefrom and receive therein the electric cable.

98. A system comprising:

means for illuminating;

means for telescoping vertically the illuminating means;

means coupled to the telescoping means for easy gliding vertical extension of the telescoping means; and means for transporting and enclosing the telescoping means fully within a horizontal perimeter boundary and a vertical perimeter boundary thereof wherein the transporting and enclosing means comprises: means for caging the telescoping means and the illuminating means; and means, coupled to the caging means, for stabilizing the illuminating means on the left and right.

99. The system of claim 98, further comprising a means for supporting the illuminating means to a left and right of a top and center of the telescoping means.

100. The system of claim 99, wherein the telescoping means includes means for rotating the telescoping means in a Y-plane.

101. The system of claim 99, wherein the telescoping means comprises a plurality of concentric telescoping sections, wherein a top of each telescoping section has a plurality of pads to create a frictionless surface between two adjacent telescoping sections.

102. The system of claim 99, wherein the telescoping means comprises a plurality of concentric telescoping sections, wherein a top of each telescoping section has a plurality of frictionless surfaces between two adjacent telescoping sections.

103. The system of claim 100, wherein the plurality of frictionless surfaces includes Teflon.

104. The system of claim 100, wherein the plurality of frictionless surfaces are oil or lubricant free.

105. The system of claim 100, wherein the plurality of frictionless surfaces includes at least one of Teflon and Graphite.

106. The system of claim 100, wherein the plurality of frictionless surfaces includes removable pads made of at least one of Teflon and Graphite.

107. The system of claim 98, further comprising means for directly mounting and stowing the telescoping means to the transporting and enclosing means in a vertically upright position.

108. The system of claim 98, wherein the mounting means includes means for swiveling the telescoping means clockwise or counter-clockwise relative to the transporting and enclosing means.

109. The system of claim 98, further comprising a bank of receptacles constructed for an off-shore environment and being mounted to the transporting and enclosing means.

110. The system of claim 98, further comprising: means for generating power; and means, coupled to the transporting and enclosing means, for housing the power generating means.

111. The system of claim 110, further comprising means, coupled to the transporting and enclosing means, for storing fuel.

112. The system of claim 98, further comprising means for automatically storing and dispensing an electrical cable, the electrical cable delivering power to the illuminating means.

113. A system comprising:

means for illuminating;

means for telescoping vertically the illuminating means;

means coupled to the telescoping means for easy gliding vertical extension of the telescoping means;

means for transporting and enclosing the telescoping means fully within a horizontal perimeter boundary and a vertical perimeter boundary thereof; and a bank of receptacles constructed for an off-shore environment and being mounted to the transporting and enclosing means.

114. The system of claim 113, further comprising a means for supporting the illuminating means to a left and right of a top and center of the telescoping means.

115. The system of claim 113, wherein the transporting and enclosing means comprises: means for caging the telescoping means and the illuminating means; and means, coupled to the caging means, for stabilizing the illuminating means on the left and right.

116. The system of claim 114, wherein the telescoping means includes means for rotating the telescoping means in a Y-plane.

117. The system of claim 114, wherein the telescoping means comprises a plurality of concentric telescoping sections, wherein a top of each telescoping section has a plurality of pads to create a frictionless surface between two adjacent telescoping sections.

118. The system of claim 114, wherein the telescoping means comprises a plurality of concentric telescoping sections, wherein a top of each telescoping section has a plurality of frictionless surfaces between two adjacent telescoping sections.

119. The system of claim 118, wherein the plurality of frictionless surfaces includes Teflon.

120. The system of claim 118, wherein the plurality of frictionless surfaces are oil or lubricant free.

121. The system of claim 118, wherein the plurality of frictionless surfaces includes at least one of Teflon and Graphite.

122. The system of claim 118, wherein the plurality of frictionless surfaces includes removable pads made of at least one of Teflon and Graphite.

123. The system of claim 113, further comprising means for directly mounting and stowing the telescoping means to the transporting and enclosing means in a vertically upright position.

124. The system of claim 113, wherein the mounting means includes means for swiveling the telescoping means clockwise or counter-clockwise relative to the transporting and enclosing means.

125. The system of claim 113, further comprising: means for generating power; and means, coupled to the transporting and enclosing means, for housing the power generating means.

126. The system of claim 125, further comprising means, coupled to the transporting and enclosing means, for storing fuel.

127. The system of claim 113, further comprising means for automatically storing and dispensing an electrical cable, the electrical cable delivering power to the illuminating means.

128. A system comprising:

means for illuminating;

means for telescoping vertically the illuminating means;

means coupled to the telescoping means for easy gliding vertical extension of the telescoping means;

means for transporting and enclosing the telescoping means fully within a horizontal perimeter boundary and a vertical perimeter boundary thereof;

means for generating power; and means, coupled to the transporting and enclosing means, for housing the power generating means.

129. The system of claim 128, further comprising a means for supporting the illuminating means to a left and right of a top and center of the telescoping means.

130. The system of claim 128, wherein the transporting and enclosing means comprises: means for caging the telescoping means and the illuminating means; and means, coupled to the caging means, for stabilizing the illuminating means on the left and right.

131. The system of claim 129, wherein the telescoping means includes means for rotating the telescoping means in a Y-plane.

132. The system of claim 129, wherein the telescoping means comprises a plurality of concentric telescoping sections, wherein a top of each telescoping section has a plurality of pads to create a frictionless surface between two adjacent telescoping sections.

133. The system of claim 130, wherein the telescoping means comprises a plurality of concentric telescoping sections, wherein a top of each telescoping section has a plurality of frictionless surfaces between two adjacent telescoping sections.

134. The system of claim 133, wherein the plurality of frictionless surfaces includes Teflon.

135. The system of claim 133, wherein the plurality of frictionless surfaces are oil or lubricant free.

136. The system of claim 133, wherein the plurality of frictionless surfaces includes at least one of Teflon and Graphite.

137. The system of claim 133, wherein the plurality of frictionless surfaces includes removable pads made of at least one of Teflon and Graphite.

138. The system of claim 133, further comprising means for directly mounting and stowing the telescoping means to the transporting and enclosing means in a vertically upright position.

139. The system of claim 128, wherein the mounting means includes means for swiveling the telescoping means clockwise or counter-clockwise relative to the transporting and enclosing means.

140. The system of claim 128, further comprising a bank of receptacles constructed for an off-shore environment and being mounted to the transporting and enclosing means.

141. The system of claim 128, further comprising means, coupled to the transporting and enclosing means, for storing fuel.

142. The system of claim 128, further comprising means for automatically storing and dispensing an electrical cable, the electrical cable delivering power to the illuminating means.

143. The system of claim 18, further comprising means, coupled to the transporting and enclosing means, for storing fuel.

144. The system of claim 25, further comprising means for automatically storing and dispensing an electrical cable, the electrical cable delivering power to the illuminating means.

145. The system of claim 25, further comprising means, coupled to the transporting and enclosing means, for storing fuel.

146. The system of claim 28, further comprising means for automatically storing and dispensing an electrical cable, the electrical cable delivering power to the illuminating means.

147. The system of claim 57, further comprising a fuel tank mounted within the transport enclosure.

148. The system of claim 147, wherein the fuel tank is mounted immediately adjacent to the housing of the engine/generator.

149. The system of claim 58, further comprising a fuel tank mounted within the transport enclosure.

150. The system of claim 149, wherein the fuel tank is mounted immediately adjacent to the housing of the engine/generator.

151. The system of claim 25, further comprising a bank of receptacles constructed for an off-shore environment and being mounted to the transporting and enclosing means.

* * * * *